US006668838B2

(12) United States Patent
Takase et al.

(10) Patent No.: US 6,668,838 B2
(45) Date of Patent: Dec. 30, 2003

(54) MANUFACTURING METHOD FOR CUT TOBACCO AND MANUFACTURING SYSTEM THEREFOR

(75) Inventors: Kazue Takase, Kanagawa (JP); Yukio Nakanishi, Kanagawa (JP); Junichi Fujiwara, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 10/219,661

(22) Filed: Aug. 16, 2002

(65) Prior Publication Data

US 2003/0010348 A1 Jan. 16, 2003

Related U.S. Application Data

(63) Continuation of application No. PCT/JP01/01093, filed on Feb. 15, 2001.

(30) Foreign Application Priority Data

Feb. 16, 2000 (JP) ..... 2000-038570

(51) Int. Cl.[7] ..... A24B 3/04; A24B 3/12

(52) U.S. Cl. ..... 131/290; 131/322

(58) Field of Search ..... 131/290–291, 131/300–312, 313–315, 322, 118

(56) References Cited

U.S. PATENT DOCUMENTS

| | | | | | |
|---|---|---|---|---|---|
| 2,596,183 | A | * | 5/1952 | Sowa | 131/291 |
| 3,204,641 | A | * | 9/1965 | Jones | 131/291 |
| 3,690,328 | A | * | 9/1972 | Quarenghi | 131/300 |
| 3,734,104 | A | * | 5/1973 | Buchanan et al. | 131/296 |
| 3,742,961 | A | * | 7/1973 | Waller | 131/306 |
| 4,004,594 | A | * | 1/1977 | Wochnowski et al. | 131/303 |
| 4,102,349 | A | * | 7/1978 | Psaras et al. | 131/303 |
| 4,235,249 | A | * | 11/1980 | Psaras et al. | 131/296 |
| 4,347,855 | A | * | 9/1982 | Lanzillotti et al. | 131/78 |
| 4,386,617 | A | * | 6/1983 | Brackmann et al. | 131/290 |
| 4,414,987 | A | * | 11/1983 | Utsch et al. | 131/296 |
| 4,449,541 | A | * | 5/1984 | Mays et al. | 131/302 |
| RE31,816 | E | * | 1/1985 | Wochnowski | 131/296 |
| 4,582,070 | A | * | 4/1986 | Jewell | 131/303 |
| 4,757,830 | A | * | 7/1988 | Halliday | 131/302 |
| 4,766,912 | A | * | 8/1988 | Hackman et al. | 131/296 |
| 4,791,942 | A | * | 12/1988 | Rickett et al. | 131/291 |
| 5,007,440 | A | * | 4/1991 | Robinson et al. | 131/369 |
| 5,165,426 | A | * | 11/1992 | Klammer et al. | 131/311 |
| 5,193,556 | A | * | 3/1993 | Lasch et al. | 131/322 |
| 5,564,444 | A | * | 10/1996 | Naylor | 131/290 |
| 5,813,413 | A | * | 9/1998 | Metzner et al. | 131/109.1 |
| 6,158,441 | A | * | 12/2000 | Grigutsch et al. | 131/296 |
| 6,502,581 | B2 | * | 1/2003 | Franke et al. | 131/303 |

FOREIGN PATENT DOCUMENTS

| | | | | |
|---|---|---|---|---|
| EP | 0651951 | * | 10/1995 | A24B/3/08 |
| JP | 57-208977 | A | 12/1982 | |
| JP | 7-184624 | A | 7/1995 | |

* cited by examiner

*Primary Examiner*—Steven P. Griffin
*Assistant Examiner*—Carlos Lopez
(74) *Attorney, Agent, or Firm*—Birch, Stewart, Kolasch & Birch, LLP

(57) ABSTRACT

In a manufacturing method and a manufacturing system for cut tobacco, a first additive mainly containing a humectant is added to laminar tobacco, the laminar tobacco provided with the first additive is shredded to form cut tobacco, a second additive containing a perfume is added to the cut tobacco, the cut tobacco is dried thereafter, and a top flavoring as a third additive is added to the dried cut tobacco.

14 Claims, 4 Drawing Sheets

MANUFACTURING METHOD FOR CUT TOBACCO AND MANUFACTURING SYSTEM THEREFOR

This application is a Continuation of copending PCT International Application No. PCT/JP01/01093 filed on Feb. 15, 2001, which was published in English and which designated the United States, and on which priority is claimed under 35 U.S.C. §120, the entire contents of which are hereby incorporated by reference.

TECHNICAL FIELD

The present invention relates to a method for manufacturing cut tobacco by shredding leafy tobacco material and a manufacturing system therefor.

BACKGROUND ART

Usually, leafy tobacco material is conditioned before a shredding process. Thereafter, an additive (so-called first flavoring) is added to the leafy tobacco material, the additive containing a perfume, humectant, water, etc. A first object of the addition of this additive is to improve the flavor of the tobacco material, and a second object is to soften the tobacco material, thereby preventing fracture of cut tobacco during the subsequent shredding process.

After the shredding process, the cut tobacco is dried, and a top flavoring (so-called second flavoring) is added to the cut tobacco. The top flavoring contains a perfume as its principal ingredient, depending on the brand of cigarettes to be manufactured from the cut tobacco.

The aforesaid additive cannot easily permeate the leafy tobacco material, and the perfume component in the additive is volatile. Thus, the additive remaining in the tobacco material after the shredding process or drying process is little.

In order to keep the residual quantity of the additive in the cut tobacco at a desired level after the cut tobacco drying process, therefore, the additive must be added in plenty to the leafy tobacco material, so that the consumption of the additive increases.

If the addition of the additive to the tobacco material is too much, however, the perfume component of the additive excessively adheres to a cutter of a shredder during the shredding process for the tobacco material. Accordingly, the cutter becomes so dull that it cannot satisfactorily shred the tobacco material, and the maintenance of the cutter takes much time.

If the residual additive quantity of the cut tobacco after the shredding process is too small, on the other hand, the cut tobacco is dried excessively in the drying process. Consequently, the cut tobacco cannot maintain its required taste and flavor, and its quality lowers.

DISCLOSURE OF THE INVENTION

The object of the present invention is to provide a manufacturing method and a manufacturing system, capable of securing the quality of cut tobacco after a drying process without failing to lower the consumption of additives and considerably improving the expansion of the cut tobacco.

In order to achieve the above object, a manufacturing method according to the present invention comprises a process for conditioning leafy tobacco material to a given water content, a process for providing the conditioned tobacco material with a first liquid additive containing a humectant, a process for shredding the tobacco material provided with the first additive, thereby obtaining cut tobacco, a process for providing the cut tobacco with a second liquid additive containing a perfume and adjusting the water content of the cut tobacco to a pre-drying water content, a process for drying the cut tobacco having the pre-drying water content to a target water content, and a process for providing the dried cut tobacco with a third additive containing a perfume.

According to the manufacturing method described above, the leafy tobacco material is first provided with the first additive that consists mainly of the humectant, so that the unshredded tobacco material is soft. Accordingly, the cut tobacco can be prevented from being fractured as the tobacco material is shredded.

Since the second additive is added to the cut tobacco, the cut tobacco efficiently absorbs the second additive that contains the perfume. If the cut tobacco is dried thereafter, the residual quantity of the second additive in the cut tobacco, that is, the residual quantity of the perfume component in the second additive, can be kept sufficient. In consequence, the consumption of the second additive can be reduced without failing to maintain the quality of the cut tobacco.

Preferably, the pre-drying water content and the target water content are adjusted to the range of 17 to 35% by weight and the range of 9 to 14% by weight of the cut tobacco, respectively, and a deviation of 5 to 25% by weight in terms of the water content is secured between the pre-drying water content and the target water content.

The deviation of the aforesaid range between the pre-drying water content and the target water content causes a sufficient quantity of water to evaporate from the cut tobacco, thereby subjecting the cut tobacco to crimpling or so-called curls, during a drying process for the cut tobacco. The curls enhance the expansion of the cut tobacco, so that the filling efficiency for the cut tobacco in cigarettes increases.

Preferably, in consideration of the maintenance of the quality of the cut tobacco, the cut tobacco drying process is carried out at a drying temperature of 80 to 300° C. In order to curl the cut tobacco with stability, moreover, the cut tobacco drying process is carried out by flash drying at 140° C. or more, and more specifically, at 140 to 280° C. Since the cut tobacco is dried in a short time according to the aforesaid flash drying, water in a firmly coupled state in the cut tobacco is quickly evaporated from the cut tobacco, whereby the formation of curls of the cut tobacco is promoted.

The aforesaid tobacco material may contain one brand selected from laminar tobaccos of the Bright brand and the Oriental brand. Further, the tobacco material may be a mixture of laminar tobaccos of the Bright brand and the Oriental brand.

The first additive may further contain a perfume. In this case, the perfume may be the same perfume that the second additive contains or a different one.

The perfume of the first additive serves to improve the flavor and taste of the cut tobacco. The addition of the perfume to the first additive is suited for the tobacco material of the Burley brand or the like that contains less natural saccharide than the tobacco materials of the Bright brand, Oriental brand, etc. do, and can improve the flavor and taste of cut tobacco that is obtained from the tobacco material of the Burley brand.

Preferably, moreover, the method further comprises a curing process for the tobacco material between the first additive providing process and the tobacco material shredding process. In this case, absorption of the first additive by the tobacco material can be promoted.

The manufacturing method of the present invention may further comprise a plurality of procedures of processing for individually carrying out the first additive providing process and the preceding processes for each of tobacco materials of a plurality of brands and a process for mixing the tobacco materials obtained according to the individual procedures of processing before the tobacco material shredding process.

In the case where the tobacco materials include tobacco materials of three brands, the Bright brand, Oriental brand, and Burley brand, a providing process for the first additive can be carried out together in the procedures of processing for individually processing the tobacco materials of the Bright brand and the Oriental brand. In this case, the same first additive is added to the tobacco materials of the Bright brand and the Oriental brand.

The manufacturing method of the present invention may further comprise a plurality of procedures of processing for individually carrying out the drying process and the preceding processes for each of tobacco materials of a plurality of brands and a process for mixing the tobacco materials obtained according to the individual procedures of processing before the third additive providing process.

In the case where the tobacco materials include tobacco materials of the Bright brand, Oriental brand, and Burley brand, the first additive providing process and the subsequent processes may be carried out in common in the procedures of processing for individually processing the tobacco materials of the Bright brand and the Oriental brand.

Further, the present invention also provides a manufacturing system for carrying out the manufacturing method described above. This manufacturing system comprises a conditioning apparatus for conditioning leafy tobacco material to a given water content, a first providing apparatus for providing the conditioned tobacco material with a first liquid additive containing a humectant, a shredder for shredding the tobacco material received from the first providing apparatus, thereby obtaining cut tobacco, a second providing apparatus for providing the cut tobacco received from the shredder with a second liquid additive containing a perfume and adjusting the water content of the cut tobacco to a pre-drying water content, and a dryer for drying the cut tobacco received from the second providing apparatus to a target water content.

Preferably, the manufacturing system further comprises a storehouse for storing the tobacco material provided with the first additive to cure the same before the tobacco material is fed to the shredder.

In order to curl the cut tobacco with stability, the dryer should preferably be a flash dryer.

BEST MODE FOR CARRYING OUT THE INVENTION

Figure 1:
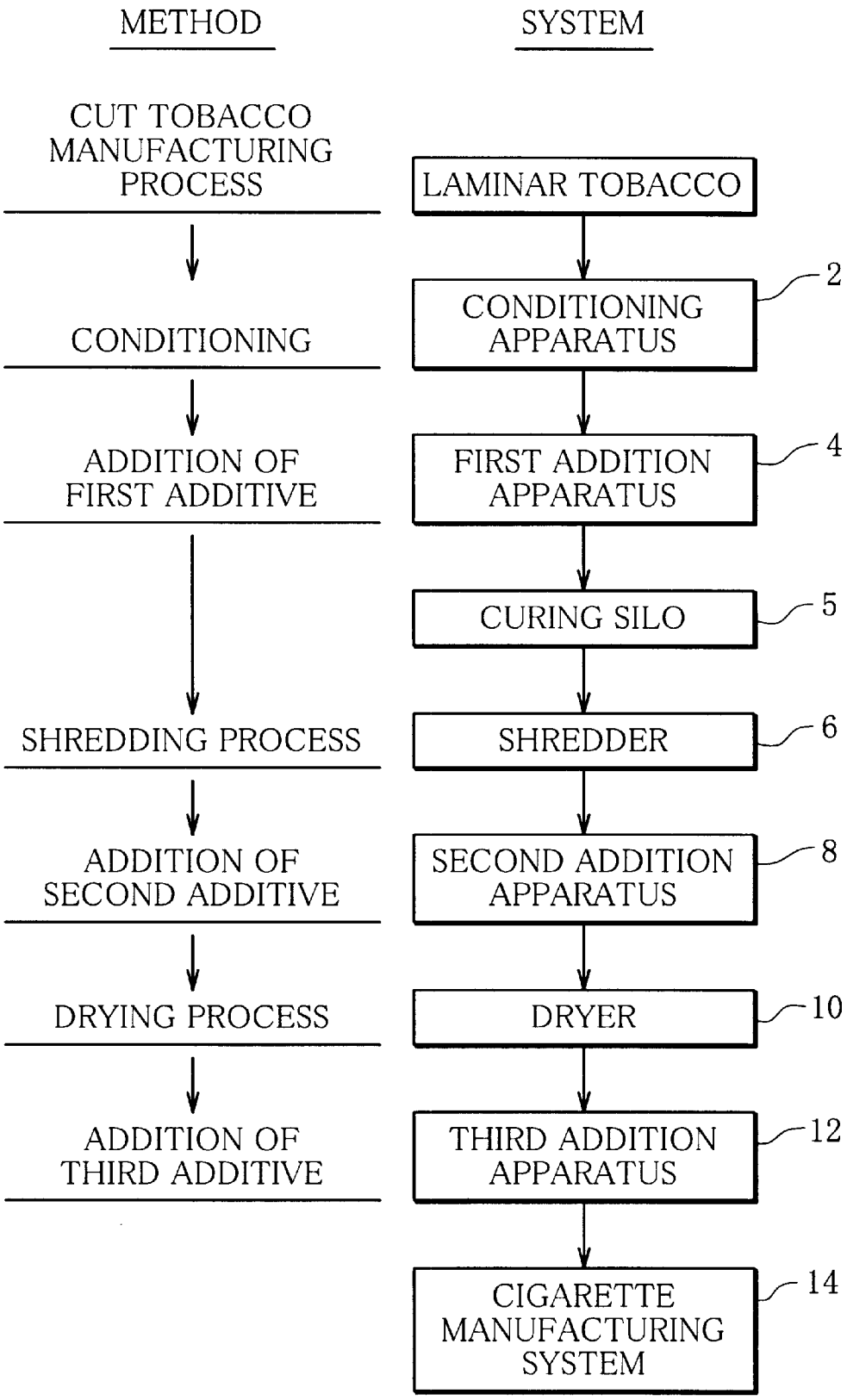
FIG. 1 is a diagram showing a fundamental cut tobacco manufacturing method and a manufacturing system according to the present invention.

FIG. 1 schematically shows a cut tobacco manufacturing method according to one embodiment of the present invention and a manufacturing system therefor.

The manufacturing system of FIG. 1 includes a conditioning apparatus 2, first addition apparatus 4, curing silo 5, shredder 6, second addition apparatus 8, dryer 10, and third addition apparatus 12.

The conditioning apparatus 2 is supplied with leafy tobacco material or laminar tobacco, and applies water, steam, and heat to the supplied laminar tobacco. In the conditioning apparatus 2, the water content of the laminar tobacco is adjusted to 14 to 17% by weight.

The first addition apparatus 4 receives the conditioned laminar tobacco from the conditioning apparatus 2, uniformly adds a first additive to the laminar tobacco, and on the other hand, applies steam and heat to it. In the first addition apparatus 4, the water content of the laminar tobacco is adjusted to 17 to 35% by weight, and preferably, to 19 to 28% by weight.

The first additive and a quantity thereof are classified as follows, depending on the brand of the laminar tobacco.

(a) Case Where the Laminar Tobacco is Based on Bright (Yellow Brand) and Oriental:

First additive: First solvent mainly contains a humectant, such as propylene glycol (PG) or glycerin (G), and doped with a perfume such as an extract of licorice, Quantity: 1 to 10% by weight, preferably 2 to 6% by weight, of the laminar tobacco supply.

(b) Case Where the Laminar Tobacco is Burley:

First additive: Second solvent contains a humectant, such as propylene glycol (PG), doped with a perfume such as cocoa, Quantity: 10 to 25% by weight, preferably 15 to 22% by weight, of the laminar tobacco supply.

Thereafter, the laminar tobacco provided with the first additive is directly supplied from the first addition apparatus 4 to the shredder 6, or is supplied from the curing silo 5 to the shredder 6 after it is temporarily stored in the curing silo 5.

The shredder 6 shreds the supplied laminar tobacco, thereby manufacturing cut tobacco of a given shred size.

The second addition apparatus 8 receives the cut tobacco from the shredder 6 and uniformly adds a second additive to the cut tobacco, thereby adjusting the water content of the cut tobacco to a pre-drying water content. More specifically, the pre-drying water content ranges from 17 to 35% by weight, and preferably, from 19 to 28% by weight, of the cut tobacco.

In the second addition apparatus 8, the second additive and a quantity thereof are also classified as follows, depending on the brand of the laminar tobacco.

(c) Case Where the Laminar Tobacco is Bright or Oriental:

Second additive: Aforesaid first solvent,

Quantity: 1 to 10% by weight, preferably 2 to 5% by weight, of the laminar tobacco supply.

(d) Case Where the Laminar Tobacco is Burley:

Second additive: Aforesaid second solvent,

Quantity: 1 to 10% by weight, preferably 2 to 5% by weight, of the laminar tobacco supply.

The dryer 10 receives the cut tobacco from the second addition apparatus 8, and dries the received cut tobacco to a target water content. The target water content ranges from 9 to 14% by weight, and preferably, from 12 to 14% by weight, of the cut tobacco.

More specifically, the cut tobacco is dried at a temperature of 80 to 300° C. in the dryer 10. Preferably, the dryer 10 is a flash dryer. In the case where the flash dryer is used, the cut tobacco is dried to a temperature of 140 to 300° C., and preferably, 160 to 260° C.

Thereafter, the dried cut tobacco is supplied to the third addition apparatus 12. In the third addition apparatus 12, a third additive is added to the cut tobacco. For example, the third additive is a perfume or so-called top flavoring, such as menthol, anethole, cinnamic aldehyde, vanillin, ethyl vanillin, peppermint oil, spearmint oil, etc.

The cut tobacco provided with the third additive is supplied from the third addition apparatus 12 to a cigarette manufacturing system 14. The cigarette manufacturing system 14 manufactures cigarettes by wrapping a filler formed of cut tobacco as a main material in paper.

More specifically, the aforesaid first to third addition apparatuses 4, 8 and 12 each include a cylinder that is stored with the material of the laminar tobacco or cut tobacco, a pin for stirring the material in the cylinder, a mist spray for spraying the additive to the material, etc.

Before the laminar tobacco is shredded, as mentioned before, it is provided with the first additive that contains the humectant by means of first addition apparatus 4 so that its water content is adjusted to 17 to 35% by weight of the laminar tobacco. Since the laminar tobacco is soft enough, therefore, the cut tobacco can be securely prevented from being fragmented as it is shredded.

The addition of the second additive to the cut tobacco by means of the second addition apparatus 8 is carried out between the process for shredding the laminar tobacco into the cut tobacco by means of the shredder 6 and the process for drying the cut tobacco by means of the dryer 10. Thus, the second additive can never adhere to a cutter of the shredder 6, and a satisfactory residual quantity can be secured for the second additive in the cut tobacco even after the cut tobacco drying process.

More specifically, the total surface area of cut tobacco in bulk, obtained from a sheet of laminar tobacco, is greater than the surface area of the sheet of laminar tobacco. Accordingly, the area of contact between the cut tobacco and the second additive is so wide that the absorption of the second additive by the cut tobacco, that is, the quantity of the second additive held in the cut tobacco, increases. If the second additive is evaporated from the cut tobacco during the subsequent drying process, therefore, the quantity of the second additive remaining in the cut tobacco after the drying process is large. In consequence, the addition of the second additive, that is, the consumption of the second additive, can be reduced since the residual quantity of the second additive in the cut tobacco is satisfactorily kept at a desired level.

As mentioned before, a good deviation is secured between the pre-drying water content obtained before the cut tobacco is dried and the target water content attained after the cut tobacco is dried, and the cut tobacco is rapidly dried at high temperature from the pre-drying water content to the target water content by means of the dryer 10. During the drying process, therefore, the force of evaporation of water from the cut tobacco is great. This great force of evaporation securely causes the cut tobacco to crimple or curl. Since curls of the cut tobacco considerably increase its expansion, the filling efficiency for the cut tobacco to be filled into cigarettes is high, and the required fill of the cut tobacco for each cigarette can be reduced considerably.

TABLE 1 below shows the result of measurements of the residual quantities of additives in samples and their expansion for the individual additive and drying manner, made on the Bright-brand laminar tobacco. In TABLE 1, glycyrrhizic acid is an ingredient of an extract of licorice.

TABLE 1

| | Bright brand | | |
|---|---|---|---|
| | Sample A | Sample B | Sample C |
| Object of additive | laminar tobacco | cut tobacco | cut tobacco |
| Drying | cylinder drying | cylinder drying | flash drying |
| Expansion (cc/g) | 4.18 | 4.50 | 4.97 |
| Residual additive quantity | | | |
| Propylene glycol (mg/g) | 8.8 | 12.9 | 10.3 |
| Glycerin (mg/g) | 5.02 | 8.49 | 8.22 |
| Glycyrrhizic acid (μg/g) | 38.8 | 45.6 | 37.5 |

Sample A in TABLE 1 was obtained by adding 7.5% by weight of the first additive and water to laminar tobacco (Bright) with a water content of 12% by weight, thereby increasing the water content of the laminar tobacco to 19% by weight, and thereafter, drying cut tobacco, obtained by shredding the laminar tobacco, to 12% by weight at a drying temperature of 110° C. by cylinder drying.

Sample B was obtained by adding 7.5% by weight of the first additive and water to cut tobacco, obtained by shredding laminar tobacco (Bright) with a water content of 19% by weight, thereby adjusting the water content of the cut tobacco to 25% by weight, and thereafter, drying the cut tobacco by cylinder drying under the same conditions for Sample A.

A process for Sample C differs from the process for Sample B only in the drying manner. More specifically, Sample C was obtained by drying cut tobacco with a water content of 25% by weight by means of a flash dryer. In this case, the drying temperature and draft speed of the flash dryer were adjusted to 260° C. and 27 m/s, respectively.

As seen from TABLE 1, the residual additive quantity of Sample B, which was obtained by adding the additive to the cut tobacco, is larger than that of Sample A, which was obtained by adding the additive to the laminar tobacco. Accordingly, Sample B is superior to Sample A in flavor and taste.

Further, the residual additive quantity of Sample C is smaller than that of Sample B. If Samples C and A are compared, however, only the residual quantity of glycyrrhizic acid in Sample C is a little smaller, and the residual quantities of propylene glycol and glycerin in Sample C are greater. Although Sample C is subjected to the intensive drying process based on flash drying, therefore, the flash drying exerts only a small bad influence upon Sample C with respect to the residual additive quantity.

On the other hand, both Samples B and C are higher than Sample A in expansion. If Samples B and C are compared, the expansion of Sample C is superior to that of Sample B. This means that curls of Sample C subjected to flash drying are larger than curls of Sample B subjected to cylinder drying. If the expansion of the cut tobacco is given priority after the residual additive quantity is kept at a level substantially equal to the level for Sample A, therefore, it is evident that the flash drying is suited for the dehydration of the cut tobacco.

It was confirmed, moreover, that the laminar tobacco of the Oriental brand also exhibits the same residual additive quantity and expansion for the case of the Bright brand.

TABLE 2 below shows the same measurement result of TABLE 1 for the laminar tobacco of the Burley brand. Theobromine in TABLE 2 is an ingredient of cocoa.

TABLE 2

| | Burley brand | | |
|---|---|---|---|
| | Sample D | Sample E | Sample F |
| Object of additive | laminar tobacco | cut tobacco | cut tobacco |
| Drying | cylinder drying | cylinder drying | flash drying |
| Expansion (cc/g) | 5.19 | 5.39 | 5.92 |
| Residual additive quantity | | | |
| Propylene glycol (mg/g) | 9.0 | 10.9 | 8.6 |
| Glycyrrhizic acid (μg/g) | 1223 | 1447 | 1354 |
| Theobromine (μg/g) | 432 | 508 | 471 |

Sample D in TABLE 2 was obtained by adding 21% by weight of the second additive and water to laminar tobacco (Burley) with a water content of 12% by weight, thereby adjusting the water content of the laminar tobacco to 25% by weight, and drying cut tobacco, obtained by shredding the laminar tobacco, to 12% by weight at a drying temperature of 110° C. by cylinder drying.

Sample E was obtained by adding 21% by weight of the second additive and water to cut tobacco, obtained by shredding laminar tobacco (Burley) with a water content of 19% by weight, thereby adjusting the water content of the cut tobacco to 25% by weight, and thereafter, drying the cut tobacco at a drying temperature of 110° C. by cylinder drying.

A process for Sample F differs from the process for Sample E only in the drying manner. More specifically, Sample F was obtained by subjecting cut tobacco to flash drying at a drying temperature of 225° C. and a draft speed of 27 m/s.

In the case of the Burley brand, as seen from TABLE 2, Samples E and F in which an additive is added to cut tobacco are superior to Sample D, and the expansion of Sample F that is subjected to flash drying is higher than that of Sample E. Sample E is superior to Sample D in the residual additive quantity. Although Sample F is a little poorer than Sample D in the residual quantity of propylene glycol only, it is superior to Sample D in the residual quantities of glycyrrhizic acid and theobromine.

Figure 2:
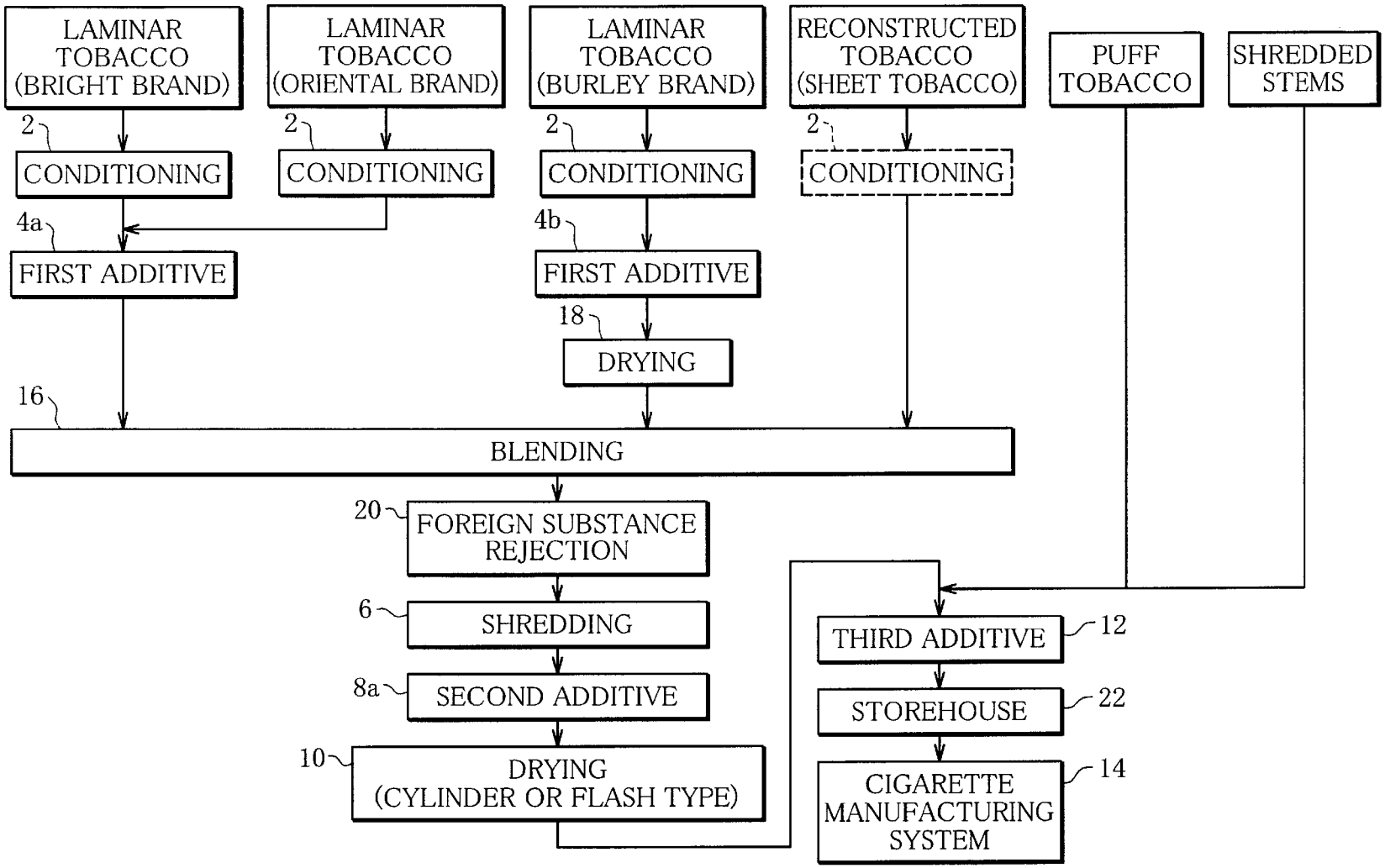
FIG. 2 is a diagram showing a manufacturing method and a manufacturing system including a blending process for laminar tobaccos of a plurality of brands carried out before these laminar tobaccos are shredded.

FIG. 2 shows a manufacturing method and manufacturing system for the case where a shredded filler is manufactured from laminar tobaccos of a plurality of brands, reconstruction tobacco, puff tobacco, and shredded stems.

The brands of laminar tobaccos used in this case are three brands, Bright, Oriental, and Burley. The puff tobacco is expanded cut tobacco, and the shredded stems are obtained by shredding stems of laminar tobacco.

First, laminar tobaccos of the three brands are individually conditioned by means of the conditioning apparatuses 2. Thereafter, the laminar tobaccos of the Bright brand and the Oriental brand are supplied together to one and the same first addition apparatus 4*a*. The first addition apparatus 4*a* adds the aforesaid first solvent to laminar tobaccos of two brands, thereby adjusting the respective water contents of these laminar tobaccos to given values, and then supplies the tobaccos to a blending silo 16.

The laminar tobaccos of the Bright brand and the Oriental brand may be provided with the first solvent by means of separate first addition apparatuses 4*a,* individually.

On the other hand, the laminar tobacco of the Burley brand is singly supplied to a first addition apparatus 4*b*. The first addition apparatus 4*b* adds the second solvent to the laminar tobacco and supplies the laminar tobacco to a dryer 18. The dryer 18 dries the laminar tobacco, thereby adjusting the water content to a given value, and then supplies the tobacco to the blending silo 16.

The reconstructed tobacco (sheet tobacco) is conditioned as required by means of a conditioning apparatus 2 and then supplied to the blending silo 16.

The blending silo 16 blends the laminar tobaccos of the three brands and the reconstructed tobacco and then supplies a mixture of these tobaccos to a foreign substance rejecter 20. The foreign substance rejecter 20 removes foreign substances from the mixture and then supplies the mixture to the shredder 6. The shredder 6 shreds the supplied mixture, forms cut tobacco, and supplies the cut tobacco to a second addition apparatus 8*a*.

The second addition apparatus 8*a* adds the first solvent to the cut tobacco, thereby adjusting the water content of the cut tobacco to the pre-drying water content, and then supplies the tobacco to the dryer 10.

The dryer 10 dries the cut tobacco, thereby adjusting the water content of the cut tobacco to the target water content. After the drying process, the cut tobacco is supplied from the dryer 10 to the third addition apparatus 12. The third addition apparatus 12 is also supplied with the puff tobacco and the shredded stems. The third addition apparatus 12 adds a top flavoring to the shredded filler or a mixture of the cut tobacco, the puff tobacco and the shredded stems, and supplies the shredded filler to a storehouse 22. The cigarette manufacturing system 14 receives the shredded filler from the storehouse 22 and forms cigarettes.

Figure 3:
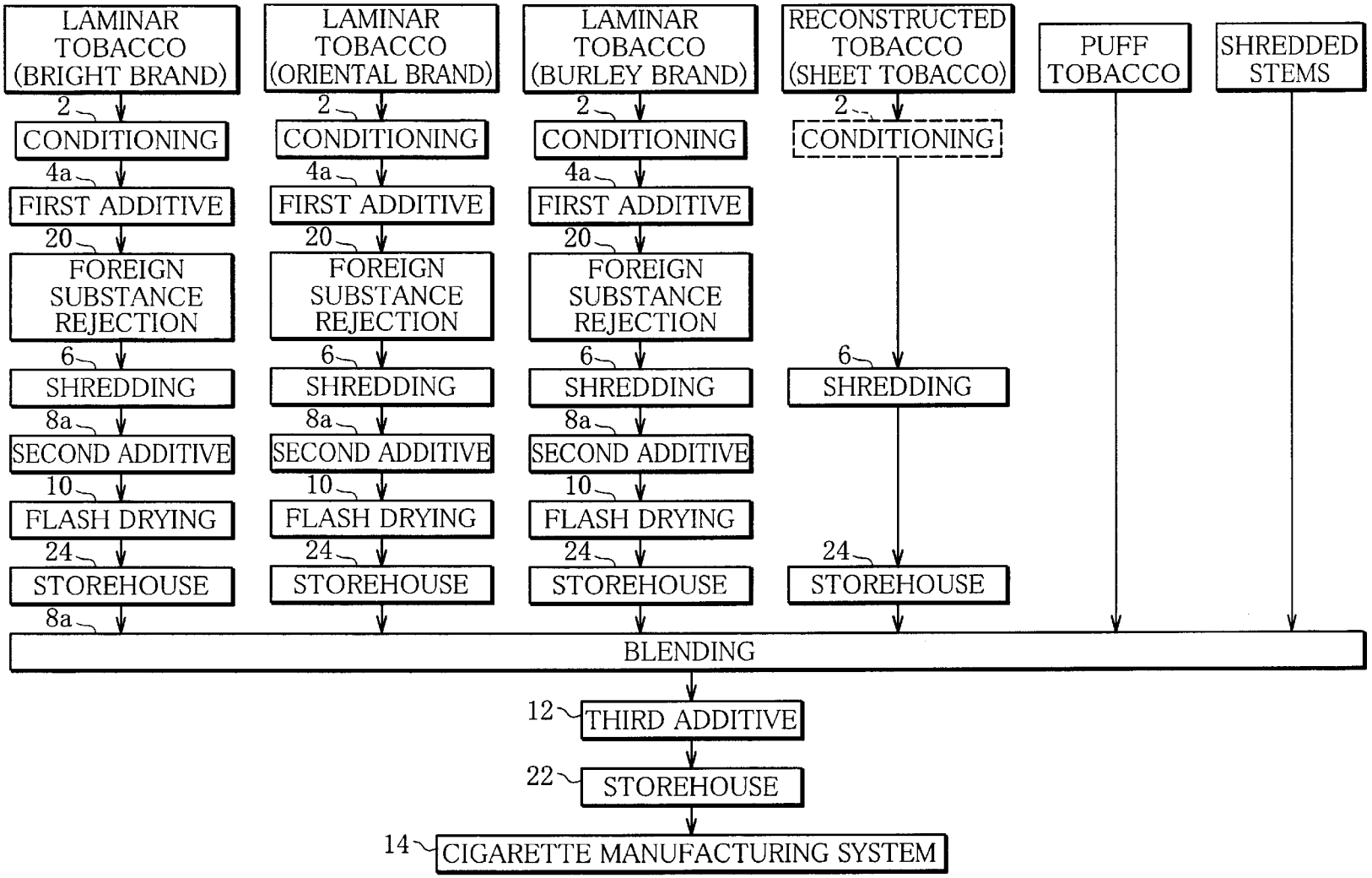
FIG. 3 is a diagram showing a manufacturing method and a manufacturing system including a blending process for laminar tobaccos of a plurality of brands carried out after these laminar tobaccos are individually shredded.

FIG. 3 shows another manufacturing method and another manufacturing system. According to this method and this system, processes including a cut tobacco drying process and its preceding processes are independently carried out for each brand of laminar tobacco, and dried cut tobaccos of individual brands are stored in storehouses 24, individually. As seen from FIG. 3, the second additive or the second solvent is added not to the laminar tobacco but to the cut tobacco. After the reconstructed tobacco is shredded, on the other hand, it is stored in a storehouse 24.

Thereafter, cut tobaccos of various brands, shredded reconstructed tobacco, puff tobacco, and shredded stems are supplied to the blending silo 16, and are mixed to form a shredded filler in the blending silo 16. The storage of the reconstructed tobacco is not indispensable.

In the case of the method and the system of FIG. 3, the laminar tobacco of the Burley brand is supplied to the foreign substance rejecter 20 without being dried after it is provided with the first additive or the first solvent.

Figure 4:
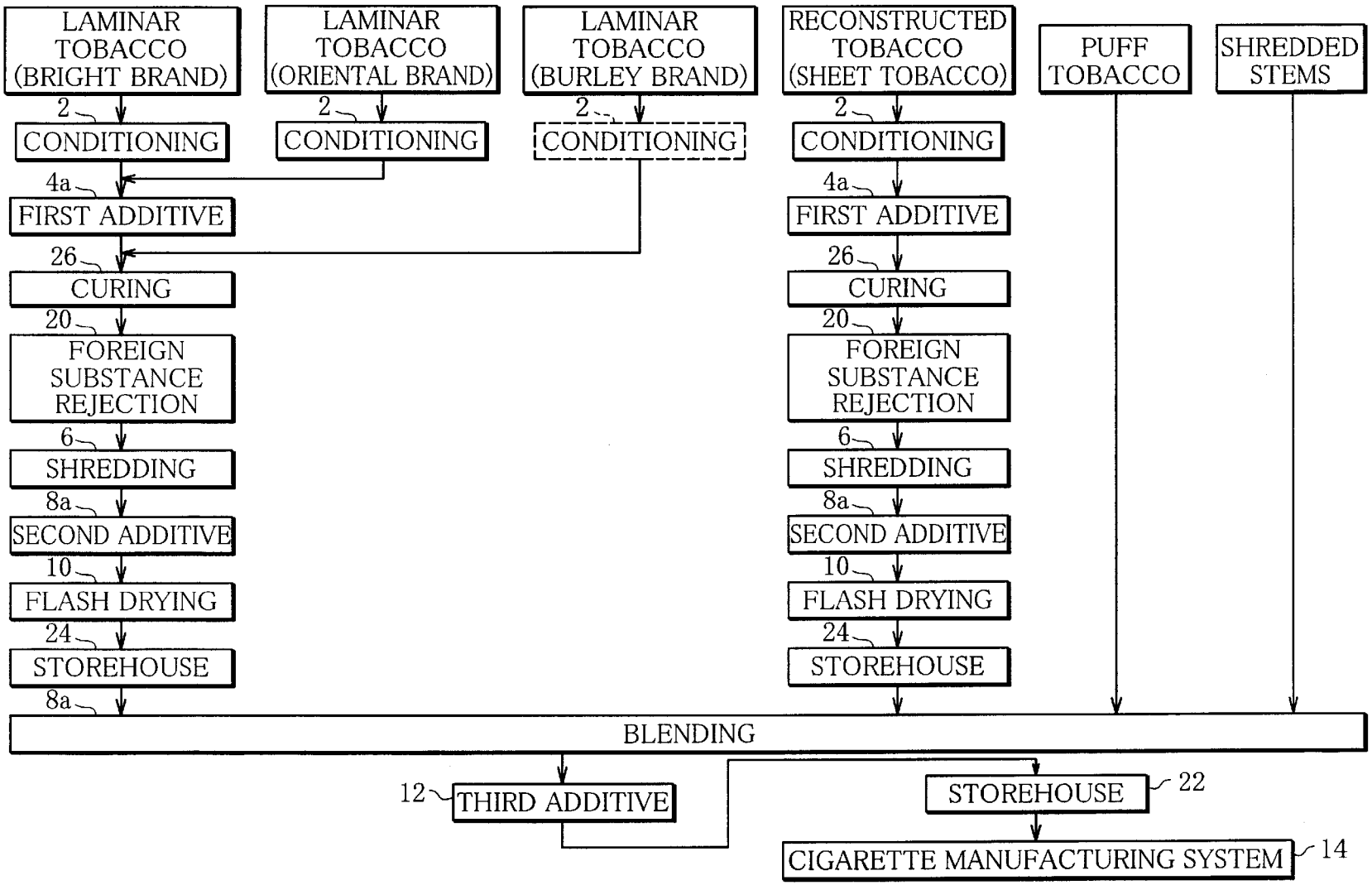
FIG. 4 is a diagram showing a modification of the method and the system of FIG. 3.

FIG. 4 shows a partial modification of the method and the system of FIG. 3. In this case, the laminar tobaccos of the Bright brand and the Oriental brand and the reconstructed tobacco are processed together in the first addition apparatus 4*a*. The laminar tobaccos processed in the first addition apparatuses 4*a* and 4*b* are stocked in curing silos 26, individually. The curing process in the curing silos 26 further promotes the permeation of the first additive (first solvent) into the laminar tobaccos.

In the methods and the systems of FIGS. 3 and 4, the cut tobacco drying process may be carried out by cylinder drying in placed of flash drying.

The present invention is not limited to the embodiment described above, various modifications may be effected therein without departing from the spirit of the present invention.

What is claimed is:

1. A cut tobacco manufacturing method, comprising the steps of:

conditioning leafy tobacco material to a given water content;

providing said conditioned tobacco material with a first liquid additive containing a humectant;

shredding said tobacco material provided with the first additive, thereby obtaining cut tobacco;

providing said cut tobacco with a second liquid additive containing a perfume and adjusting the water content of said cut tobacco to a pre-drying water content;

drying said cut tobacco having said pre-drying water content to a target water content; and providing said dried cut tobacco with a third additive containing a perfume.

2. A method according to claim 1, wherein said predrying water content is adjusted to 17 to 35% by weight of said cut tobacco, said target water content is adjusted to 9 to 14% by weight of said cut tobacco, and a deviation of 5 to 25% by weight in terms of the water content is secured between said pre-drying water content and said target water content.

3. A method according to claim 1, wherein said cut tobacco drying step is carried out at a drying temperature of 80 to 300° C.

4. A method according to claim 2, wherein said cut tobacco drying step is carried out by flash drying at 140° C. or more.

5. A method according to claim 1, wherein said tobacco material contains one brand selected from a group of laminar tobaccos consisting of a Bright brand and an Oriental brand.

6. A method according to claim 1, wherein said first additive further contains a perfume.

7. A method according to claim 1, further comprising a step of curing said tobacco material between said steps of providing said first additive and shredding said tobacco material.

8. A method according to claim 1, wherein the steps of conditioning the tobacco material and providing the conditioned tobacco with a first liquid additive are performed individually for each of the tobacco materials of a plurality of brands, and the tobacco materials obtained thereby are mixed before being subjected to said tobacco material shredding step.

9. A method according to claim 8, wherein said tobacco materials are selected from the group consisting of a Bright brand, an Oriental brand, and a Burley brand, and the first additive is provided concurrently to the tobacco materials of the Bright brand and the Oriental brand.

10. A method according to claim 1, wherein the steps of conditioning the tobacco material, providing the conditioned tobacco with a first liquid additive, shredding the tobacco material, providing the cut tobacco with a second liquid additive, and drying the cut tobacco are performed individually for each of the tobacco materials of a plurality of brands, and the tobacco materials obtained thereby are mixed before being subjected to said step of providing the dried, cut tobacco with a third additive.

11. A method according to claim 10, wherein said tobacco materials are selected from the group consisting of a Bright brand, an Oriental brand, and a Burley brand, and the first additive is provided concurrently to the tobacco materials of the Bright brand and the Oriental brand.

12. A cut tobacco manufacturing system, comprising:

a conditioning apparatus for conditioning leafy tobacco material to a given water content;

a first providing apparatus for providing said conditioned tobacco material with a first liquid additive containing a humectant;

at least one curing silo for storing said tobacco material provided with said first additive to cure the tobacco material;

a shredder for shredding said tobacco material received from said at least one curing silo, thereby obtaining cut tobacco;

a second providing apparatus for providing said cut tobacco received from said shredder with a second liquid additive containing a perfume and adjusting the water content of said cut tobacco to a pre-drying water content; and a dryer for drying said cut tobacco received from said second providing apparatus to a target water content.

13. A system according to claim 12, wherein said dryer is a flash dryer.

14. A cut tobacco manufacturing apparatus, comprising:

a conditioning apparatus for conditioning leafy tobacco material to a given water content;

a first providing apparatus for providing said conditioned tobacco material with a first liquid additive containing a humectant;

a shredder for shredding said tobacco material received from said first providing apparatus, thereby obtaining cut tobacco;

a second providing apparatus for providing said cut tobacco received from said shredder with a second liquid additive containing a perfume and adjusting the water content of said cut tobacco to a pre-drying water content;

a dryer for drying said cut tobacco received from said second providing apparatus to a target water content; and a third providing apparatus for providing said dried cut tobacco with a third additive containing a perfume.

* * * * *